US008864293B2

(12) United States Patent
Platt et al.

(10) Patent No.: US 8,864,293 B2
(45) Date of Patent: Oct. 21, 2014

(54) PHASE CHANGE INK RESERVOIR FOR A PHASE CHANGE INKJET PRINTER

(75) Inventors: David Paul Platt, Newberg, OR (US); David L. Knierim, Wilsonville, OR (US); Tesfalem Zewdneh, Clackamas, OR (US)

(73) Assignee: Xerox Corporation, Norwalk, CT (US)

( * ) Notice: Subject to any disclaimer, the term of this patent is extended or adjusted under 35 U.S.C. 154(b) by 181 days.

(21) Appl. No.: 13/611,148

(22) Filed: Sep. 12, 2012

(65) Prior Publication Data

US 2014/0071205 A1 Mar. 13, 2014

(51) Int. Cl.
*B41J 2/175* (2006.01)
*B41J 2/19* (2006.01)

(52) U.S. Cl.
USPC ..... 347/88; 347/92

(58) Field of Classification Search
None
See application file for complete search history.

(56) References Cited

U.S. PATENT DOCUMENTS

| | | | | |
|---|---|---|---|---|
| 4,771,295 | A | 9/1988 | Baker et al. | |
| 5,047,790 | A | 9/1991 | Cowger et al. | |
| 5,105,209 | A * | 4/1992 | Koto et al. | 347/70 |
| 5,121,132 | A | 6/1992 | Pan et al. | |
| 5,262,802 | A | 11/1993 | Karita et al. | |
| 5,363,130 | A | 11/1994 | Cowger et al. | |
| 5,600,358 | A | 2/1997 | Baldwin et al. | |
| 5,742,312 | A | 4/1998 | Carlotta | |
| 5,875,615 | A | 3/1999 | Ito et al. | |
| 5,989,698 | A | 11/1999 | Mrozinski et al. | |
| 6,969,165 | B2 | 11/2005 | Olsen | |
| 7,748,830 | B2 * | 7/2010 | Platt et al. | 347/85 |
| 7,976,286 | B2 | 7/2011 | Kim et al. | |
| 8,079,691 | B2 * | 12/2011 | Koehler et al. | 347/88 |
| 2010/0271424 | A1 * | 10/2010 | Cunnington et al. | 347/33 |
| 2011/0074863 | A1 | 3/2011 | Platt | |
| 2011/0169883 | A1 | 7/2011 | Platt et al. | |
| 2012/0098898 | A1 | 4/2012 | Park et al. | |

* cited by examiner

*Primary Examiner* — Geoffrey Mruk
(74) *Attorney, Agent, or Firm* — Maginot Moore & Beck LLP

(57) ABSTRACT

A phase change inkjet printer including a heated phase change ink reservoir configured to reduce or prevent improper jetting of ink from a printhead. The reservoir includes a vent to atmosphere to provide substantially consistent and accurate jetting of the heated ink. A selective barrier, such as a filter, disposed adjacent to the vent substantially prevents ink from entering the vent while still enabling the vent to direct a pressure into the reservoir during printing and during purging.

20 Claims, 4 Drawing Sheets

PHASE CHANGE INK RESERVOIR FOR A PHASE CHANGE INKJET PRINTER

TECHNICAL FIELD

This disclosure relates generally to a phase change inkjet printer, and more particularly to a phase change ink reservoir having a selective barrier to reduce or prevent phase change ink from blocking an air vent.

BACKGROUND

In general, inkjet printing machines or printers include at least one printhead unit that ejects drops of liquid ink onto an imaging receiving member. Ink jet printers have printheads that operate a plurality of inkjets that eject liquid ink onto the image receiving member. The ink can be stored in reservoirs located within cartridges installed in the printer. Different types of ink can be used in inkjet printers. Such ink can be aqueous ink or an ink emulsion. Other inkjet printers can use ink that is supplied in a gel form. The gel is heated to a predetermined temperature to alter the viscosity of the ink so the ink is suitable for ejection by a printhead.

Other inkjet printers receive ink in a solid form and then melt the solid ink to generate liquid ink for ejection onto the image receiving member. These inks are called phase change inks. Phase change inks remain in a solid phase at ambient temperature, but transition to a liquid phase at an elevated temperature. The printhead unit ejects molten ink supplied to the unit onto the image receiving member. Once the ejected ink is on image receiving member, the ink droplets solidify. In these solid ink printers, the solid ink can be in the form of pellets, ink sticks, granules or other shapes. The solid ink pellets or ink sticks are typically placed in an ink loader and delivered through a feed chute or channel to a melting device that melts the ink. The melted ink is then collected in a reservoir and supplied to one or more printheads through a conduit or the like.

An inkjet printer can include one or more printheads. Each printhead contains an array of individual nozzles for ejecting drops of ink across an open gap to the image receiving member to form an image. The image receiving member can be a continuous web of recording media, one or more media sheets, or a rotating surface, such as a print drum or endless belt. Images printed on a rotating surface are later transferred to recording media, either continuous or sheet, by a mechanical force in a transfix nip formed by the rotating surface and a transfix roller.

In an inkjet printhead, individual piezoelectric, thermal, or acoustic actuators generate mechanical forces that expel ink through an orifice from an ink filled conduit in response to an electrical voltage signal, sometimes called a firing signal. The amplitude, or voltage level, of the signals affects the amount of ink ejected in each drop. The firing signal is generated by a printhead controller in accordance with image data. An inkjet printer forms a printed image in accordance with the image data by printing a pattern of individual ink drops at particular locations on the image receiving member. The locations where the ink drops landed are sometimes called "ink drop locations," "ink drop positions," or "pixels." Thus, a printing operation can be viewed as the placement of ink drops on an image receiving member in accordance with image data.

The environment in which printers, printer ink, and image receiving members are used is not always ideal. Several sources of printing errors exist and can result from ink contamination, improper heating of phase change ink, and improper maintenance of a printer. Additionally, not all inkjet nozzles in a printhead remain operational without maintenance. Some inkjet nozzles can become intermittent, meaning the inkjet nozzle can fire some times and not at other times. To reduce or eliminate intermittent firing, ink jet printheads and the reservoirs supplying ink to the nozzles can include filters designed to filter out or block contaminants from entering the inkjets. Other inkjet printers, particularly those depositing phase change ink, include a purge operation where the printhead nozzles are purged of ink on a routine basis.

When a phase change printer is not operated for a period of time, such as overnight, the phase change ink can become viscous or even solidify. This change in state is typically temporary and does not pose a risk to the proper operation of the printer, once the printer has been returned to an operating temperature needed for printing after the period of nonuse. To ensure the printer is ready for printing, a purge operation can be performed to purge the printhead nozzles of any blockages or air bubbles. In some cases, however, the phase change ink can migrate to other locations in the printer, including the printheads, the ink reservoirs, and even ink conduits, where the phase change ink is not sufficiently liquefied due to location. Consequently it is desirable to reduce the likelihood that phase change ink migrates to a location within a printer where proper liquefaction of the phase change ink is difficult, impossible or not economically advantageous.

SUMMARY

A phase change inkjet printhead assembly includes a heated phase change ink reservoir configured to reduce or prevent improper jetting of ink from the nozzles of a printhead. The reservoir includes a vent to atmosphere to provide consistent and accurate jetting of the heated ink. A selective barrier, such as a filter, disposed adjacent to the vent substantially prevents ink from entering the vent while still enabling the vent to direct a pressure into the reservoir during printing and during purging.

A printhead assembly for use in an imaging device deposits melted phase change ink on an image receiving member. The printhead assembly includes a housing defining a chamber to hold a supply of the heated phase change ink. The housing includes a phase change ink inlet configured to deliver heated phase change ink to the chamber, a phase change ink outlet configured to deliver liquid phase change ink from the chamber, and a vent configured to expose the chamber to a gas pressure. A selective barrier is spaced a predetermined distance from the vent. The selective barrier includes a plurality of holes having a size configured to substantially prevent a pressure within the chamber to move the liquid phase change ink into the vent. A plurality of ink drop actuators, operatively connected to the phase change ink outlet, emit drops of melted phase change ink on the image receiving member.

A phase change ink storage reservoir supplies heated phase change ink to a printhead. The phase change ink reservoir includes a housing defining a chamber to hold a supply of heated phase change ink. The housing includes a phase change ink inlet configured to deliver heated phase change ink to the chamber. The reservoir further includes a phase change ink outlet operatively connected to the printhead which is configured to deliver liquid phase change ink from the chamber to the printhead. A vent is configured to expose the chamber to a gas pressure. A selective barrier is spaced a predetermined distance from the vent. The selective barrier includes a plurality of holes having a size configured to substantially prevent a pressure within the chamber to move the liquid phase change ink into the vent.

A method of printing uses phase change ink ejected from a plurality of inkjet apertures which are configured to receive ink from an ink reservoir having an ink inlet, an air vent, and a selective barrier spaced a predetermined distance from the air vent. The method includes heating the reservoir to maintain the phase change ink within the reservoir in a liquid state, applying a pressure to the reservoir through the air vent and the selective barrier, delivering ink to the reservoir through the ink inlet, and purging phase change ink through the plurality of inkjet apertures.

DETAILED DESCRIPTION

Figure 1:
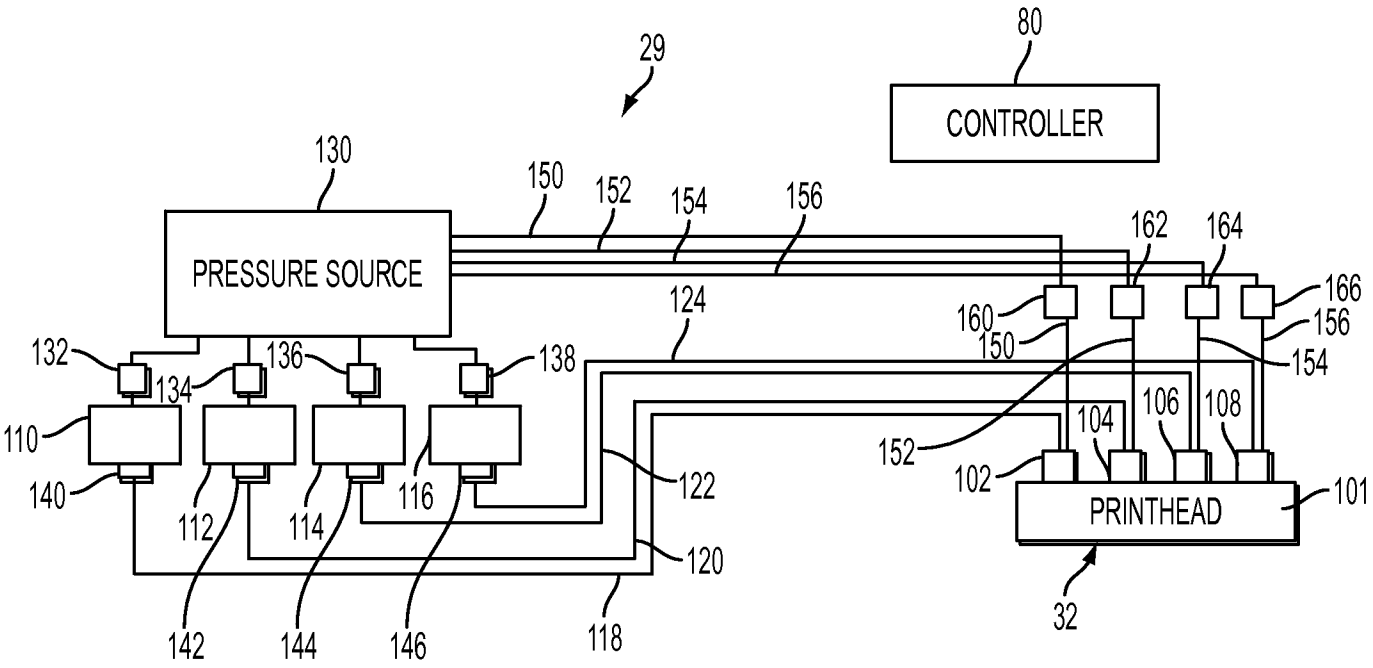
FIG. 1 is schematic block diagram of one embodiment of ink delivery components of an inkjet printer.

For a general understanding of the environment for the system and method disclosed herein as well as the details for the system and method, the drawings are referenced throughout this document. In the drawings, like reference numerals designate like elements. As used herein the term "printer" or "printing system" refers to any device or system that is configured to eject a marking agent upon an image receiving member and includes photocopiers, facsimile machines, multifunction devices, as well as direct and indirect inkjet printers and any imaging device that is configured to form images on a print medium.

Figure 7:
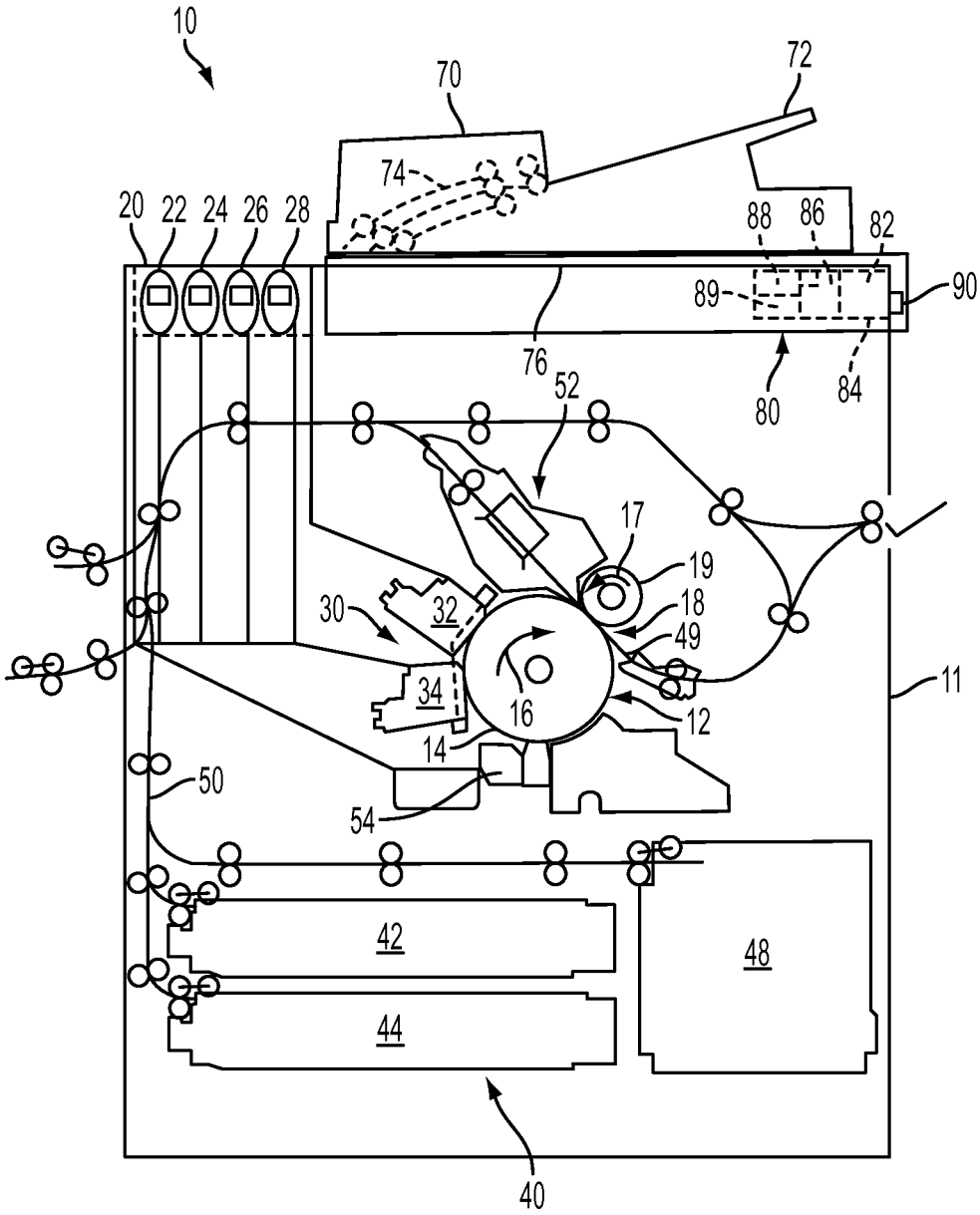
FIG. 7 PRIOR ART
FIG. 7 is a schematic view of an inkjet printer configured to print images onto a rotating image receiving member and to transfer the images to recording media.

FIG. 7 depicts a prior art inkjet printer 10 having elements pertinent to the present disclosure. In the embodiment shown, the printer 10 implements a solid ink print process for printing onto sheets of recording media. Although the inkjet printer and inkjet printheads are described below with reference to the printer 10 depicted in FIG. 7, the subject method and apparatus disclosed herein can be used in any printer, continuous web inkjet printer or cartridge inkjet printers, having printheads which eject ink directly onto a web image substrate or sheets of recording media.

FIG. 7 illustrates a prior art high-speed phase change ink image producing machine or printer 10. As illustrated, the printer 10 includes a frame 11 supporting directly or indirectly operating subsystems and components, as described below. The printer 10 includes an image receiving member 12 that is shown in the form of a drum, but can also include a supported endless belt. The image receiving member 12 has an imaging surface 14 that is movable in a direction 16, and on which phase change ink images are formed. A transfix roller 19 rotatable in the direction 17 is loaded against the surface 14 of drum 12 to form a transfix nip 18, within which ink images formed on the surface 14 are transfixed onto a recording media 49, such as a heated media sheet.

The high-speed phase change ink printer 10 also includes a phase change ink delivery subsystem 20 that has at least one source 22 of one color phase change ink in solid form. Since the phase change ink printer 10 is a multicolor image producing machine, the ink delivery system 20 includes four (4) sources 22, 24, 26, 28, representing four (4) different colors CYMK (cyan, yellow, magenta, black) of phase change inks. The phase change ink delivery system also includes a melting and control apparatus 29, not shown in FIG. 1, for melting or phase changing the solid form of the phase change ink into a liquid form. The phase change ink delivery system 29 is suitable for supplying the liquid form to a printhead system 30 including at least one printhead assembly 32. Each printhead assembly 32 includes at least one printhead configured to eject ink drops onto the surface 14 of the image receiving member 12 to produce an ink image thereon. Since the phase change ink printer 10 is a high-speed, or high throughput, multicolor image producing machine, the printhead system 30 includes multicolor ink printhead assemblies and a plural number (e.g., two (2)) of separate printhead assemblies 32 and 34 as shown, although the number of separate printhead assemblies can be one or more.

As further shown, the phase change ink printer 10 includes a recording media supply and handling system 40, also known as a media transport. The recording media supply and handling system 40 can include sheet or substrate supply sources 42, 44, 48, of which supply source 48, for example, is a high capacity paper supply or feeder for storing and supplying image receiving substrates in the form of cut media sheets 49. The recording media supply and handling system 40 also includes a substrate handling and treatment system 50 that has a substrate heater or pre-heater assembly 52. The phase change ink printer 10 as shown can also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 is operably connected to the image receiving member 12, the melting and control apparatus 29, the printhead assemblies 32, 34 (and thus the printheads), and the substrate supply and handling system 40. The ESS or controller 80, for example, is a self-contained, dedicated mini-computer having a central processor unit (CPU) 82 with electronic storage 84, and a display or user interface (UI) 86. A temperature sensor 54 is operatively connected to the controller 80. The temperature sensor 54 is configured to measure the temperature of the image receiving member surface 14 as the image receiving member 12 rotates past the temperature sensor 54. In one embodiment, the temperature sensor is a thermistor that is configured to measure the temperature of a selected portion of the image receiving member 12. The controller 80 receives data from the temperature sensor and is configured to identify the temperatures of one or more portions of the surface 14 of the image receiving member 12.

The ESS or controller 80 can include a sensor input and control circuit 88 as well as a pixel placement and control circuit 89. In addition, the CPU 82 reads, captures, prepares and manages the image data flow between image input sources, such as the scanning system 76, or an online or a work station connection 90, and the printhead assemblies 32 and 34. As such, the ESS or controller 80 is the main multitasking processor for operating and controlling all of the other machine subsystems and functions, including the printing process discussed below.

The controller 80 can be implemented with general or specialized programmable processors that execute programmed instructions. The instructions and data required to perform the programmed functions can be stored in memory associated with the processors or controllers. The processors, associated memories, and interface circuitry configure the controllers to perform the processes that enable the printer to perform heating of the image receiving member, depositing of the ink, and drum maintenance unit cycles. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integration (VLSI) circuits. Also, the circuits described herein can be implemented with a combination of processors, ASICs, discrete components, or VLSI circuits. Additionally, the controller 80 determines and/or accepts related subsystem and component controls, for example, from operator inputs via the user interface 86, and accordingly executes such controls. As a result, appropriate color solid forms of phase change ink are melted and delivered to the printhead assemblies 32 and 34. In addition, the operator can execute the purging of one or more printheads, as described herein, through an input command made at the user interface. In some printing operations, a single ink image can cover the entire surface of the imaging member 12 (single pitch) or a plurality of ink images can be deposited on the imaging member 12 (multi-pitch). Furthermore, the ink images can be deposited in a single pass (single pass method), or the images can be deposited in a plurality of passes (multi-pass method). In a multi-pitch printing architecture, the surface of the image receiving member is partitioned into multiple segments, each segment including a full page image (i.e., a single pitch) and an interpanel zone or space. For example, a two pitch image receiving member 12 is capable of containing two images, each corresponding to a single sheet of recording medium, during a revolution of the image receiving member 12. Likewise, for example, a three pitch intermediate transfer drum is capable of containing three images, each corresponding to a single sheet of recording medium, during a pass or revolution of the image receiving member 12.

Once an image has been formed on the image receiving member 12 under control of the controller 80 in accordance with an imaging method, the exemplary inkjet printer 10 converts to a process for transferring and fixing the image or images at the transfix roller 19 from the image receiving member 12 onto a recording medium 49. According to this process, a sheet of recording medium 49 is transported by a transport under control of the controller 80 to a position adjacent the transfix roller 19 and then through a nip formed between the transfix roller 19 and image receiving member 12. The transfix roller 19 applies pressure against the back side of the recording medium 49 in order to press the front side of the recording medium 49 against the image receiving member 12.

Referring now to FIG. 1, the printer system 10 is modified to include a melting and control apparatus 29. As illustrated in the schematic block diagram of FIG. 1 including the controller 80 and the printhead assembly 32, the printhead assembly 32 includes a printhead 101, or more than one printhead, that receives ink from a plurality of on-board ink reservoirs 102, 104, 106, and 108, each of which are fluidly connected to the printhead 101. The on-board ink reservoirs 102, 104, 106, and 108 respectively receive ink from a plurality of remote ink containers 110, 112, 114, and 116 via respective ink supply channels 118, 120, 122, and 124.

The ink delivery system 20 of FIG. 7 supplies ink to the remote ink containers 110, 112, 114, and 116. The illustrated inkjet printer 10 is a phase change ink imaging device. Accordingly, the ink delivery system comprises a phase change ink delivery system 20 that has at least one source of at least one color of phase change ink in solid form. The phase change ink delivery system also includes a melting apparatus for melting the solid form of the phase change ink into a liquid form and delivering the melted ink to the appropriate remote ink container.

The remote ink containers 110, 112, 114, and 116 are configured to supply melted phase change ink to the on-board ink reservoirs 102, 104, 106, and 108. In one embodiment, the remote ink containers 110, 112, 114, and 116 can be selectively pressurized, for example by compressed air, which is provided by a source of compressed air 130 via a plurality of valves 132, 134, 136 and 138. The flow of ink from the remote containers 110, 112, 114, and 116 to the reservoirs 102, 104, 106, and 108, which can be integrated within the printhead assembly 32, can be pressurized by fluid or by gravity, for example. Output valves 140, 142, 144, and 146 are provided to control the flow of ink to the on-board ink reservoirs 102, 104, 106, and 108.

The on-board ink reservoirs 102, 104, 106, and 108 can also be selectively pressurized, for example by selectively pressurizing the remote ink containers 110, 112, 114, and 116 and by pressurizing one or more air channels or conduits 150, 152, 154, and 156. Each of the conduits 150, 152, 154, and 156 can be selectively pressurized under control of respective valves 160, 162, 164, and 166. Alternatively, the ink supply channels 118, 120, 122, and 124 can be closed, for example by closing the output valves 140, 142, 144, and 146 and by pressurizing one or more of the desired air channels 150, 152, 154, and 156. The on-board ink reservoirs 102, 104, 106, and 108 can be pressurized to perform cleaning or purging operations on the printhead 32, for example. Each of the onboard reservoirs 102, 104, 106, and 108 can be selectively purged by opening one or more of the respective valves 160, 162, 164, and 166. Consequently, a single color of ink can be purged through the associated nozzles. The on-board ink reservoirs 102, 104, 106, and 108 and the remote ink containers 110, 112, 114, and 116 can be heated and configured to store melted solid ink. The ink supply channels 118, 120, 122, and 124 can also be heated.

The on-board ink reservoirs 102, 104, 106, and 108 are vented to atmosphere during normal printing operation, for example by controlling one or more of the valves 160, 162, 164, and 166 to vent the air channels 150, 152, 154, and 156 to atmosphere. The on-board ink reservoirs 102, 104, 106, and 108 can also be vented to atmosphere during non-pressurizing transfer of ink from the remote ink containers 110, 112, 114, and 116 (i.e., when ink is transferred without pressurizing the on-board ink reservoirs 102, 104, 106, and 108).

Figure 2:
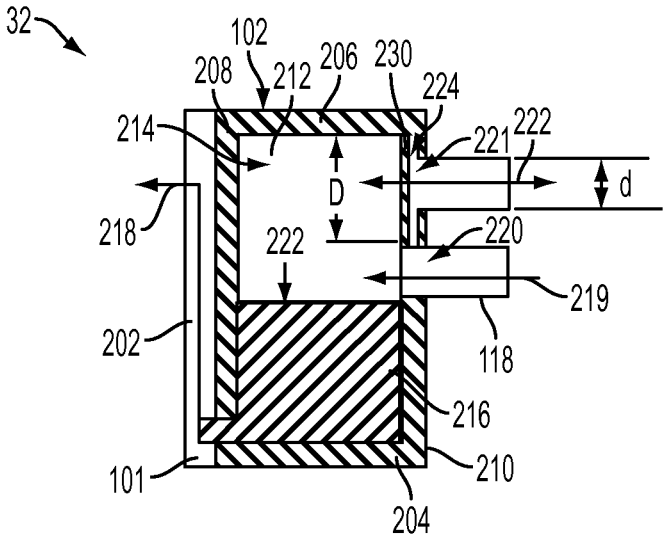
FIG. 2 is a simplified schematic side cross-sectional view of one embodiment of a printhead in a printing position including an ink reservoir.

FIG. 2 illustrates a cross-sectional view of one embodiment of the printhead assembly 32 including one of the ink reservoirs 102. Once liquid ink reaches the printhead 101 via the ink supply channel 118, the liquid ink is collected in the on-board reservoir 102. The on-board reservoir is configured for fluid communication of the ink to an array of nozzles 202 that includes a plurality of inkjets for ejecting the ink onto the image receiving member as illustrated in FIG. 7 or directly to a sheet of recording media (not shown).

The reservoir 102 includes a bottom wall 204 and a top wall 206 each of which is operatively connected to a front wall 208 and a back wall 210. A first side wall 212 and a second side wall (not shown) are operatively connected to the bottom and top walls 204 and 206, to the front wall 208, and to the back wall 210 to define a chamber 214 for holding a supply of phase change ink 216. In one embodiment, the reservoir 102 is formed of a metal, such as aluminum, which is heated by a heater (not shown) to maintain the temperature of the phase change ink in a melted or liquid state. In one embodiment of phase change ink, the temperature of the liquefied ink can be between 90 degrees Celsius and 115 degrees Celsius.

To eject ink through the array of nozzles 202 in a direction 218, ink is delivered from one of the remote ink containers such as remote ink container 110. The ink is heated at the ink container 110 and the flow of ink through the heated conduit 118 is controlled by the output valve 140. Heated ink flows in the direction 219 along the conduit 118 through an ink inlet 220 formed in the back wall 210 for storage in the heated chamber 214. The ink inlet 220 can include a fitting adapted to couple to the conduit 118.

To enable the ejection of ink through the array of nozzles 202, the reservoir 102 includes a vent or vent aperture 221 disposed in the back wall 210. The vent 221 can also include a fitting to couple the vent 221 to the conduit 150. While the vent 221 is illustrated as being disposed on the same wall as the ink inlet 220, locations on other walls are possible. The vent 221 is also called an atmospheric air vent. In addition, the vent 221 is located above (as illustrated) a top surface 222 of the ink to enable the vent 221 to vent to the pressure source 130 through the air channel valve 160 and the conduit 150. By opening and closing the valve 160, the chamber can be pressurized to provide for proper ejection of ink and for purging operations. The pressurization can be applied to or from the chamber in the direction 222. During printing in one embodiment, the valve 160 can be vented to atmosphere where the pressure source is adapted to open to atmosphere or to provide pressure equivalent to atmospheric pressure.

The solid ink printheads, as described herein, include an atmospheric air vent in the ink storage reservoir to allow the reservoir to "breathe" while loading or depositing ink. Without a functioning atmospheric air vent, a positive pressure can be induced while loading ink into the reservoir 102 holding ink for delivery to the printhead. As a consequence, the ink can drool from the nozzles, and a large number of nozzles can fail which then can requires a user to purge the printhead. Without a functioning vent to atmosphere, a vacuum can be generated within the reservoir 102 holding ink as ink is ejected from the nozzles. Once the vacuum reaches a certain level, the nozzles can become unstable, and massive nozzle failure can occur requiring a purge. If the reservoir vent to atmosphere becomes obstructed, either partially or completely, one or more nozzles can fail. If vent obstruction persists, purging of the printhead nozzles is insufficient to correct the problem, and the entire printhead assembly or printhead is replaced.

An air vent in a reservoir can become obstructed when hot ink enters the air vent or enters the conduits coupling a pressure source to the air vent. One failure mode can occur when the printer is moved from one location to another while the ink is liquefied. If the printer is moved without proper care, the hot ink can splash or move into an air vent thereby plugging the vent path to atmosphere once it cools and solidifies. In some instances, ink can splash into an air vent or air conduit by moving a printer from one side to another side of a user's desk.

To reduce or eliminate the likelihood of ink moving into the vent 221, the vent 221 interfaces with a larger opening 224 which can include a circular, rectangular, or other cross-sectional configuration. When the vent 221 is defined as a circular opening, the diameter of the vent 221 has a diameter of length "d". The opening 224, also formed in the back wall 210 and operatively connected to the vent 221, is generally larger in at least one respect to the vent 221. In the illustrated embodiment, the opening 224 defines a circular configuration having a diameter of a length "D", where the length "D" is larger than the length of the diameter "d" of the vent 221. Consequently, an area defined by a cross section of the opening 224 taken along the length D is larger than an area defined by a cross section of the vent 221 taken along the length d. The transition in size of the opening 221 to the opening 224 can prevent excessive pressure drop during purging of the printheads.

A selective barrier 230, or filter, can be disposed within the opening 224 and is displaced a distance D1 (see FIG. 4) from the vent aperture 221 to define a space 231 having the diameter D and a depth D1. The space 231 is an area between the vent 221 and a surface of the barrier 230. The selective barrier 230 includes a plurality of holes or apertures 232 (See FIGS. 4, 5, and 6) which enables the application of pressure, positive or negative, from the pressure source 130 to the chamber 214. To prevent significant change in the amount of pressure provided by the pressure source 130 at the chamber 214, the selective barrier 230 is spaced from the vent 221 by the space 231. While the vent 221 and the opening 224 are shown as having distinct configurations, the vent 221 and opening 224 can be defined as a single opening having an interior wall that continuously transitions from the vent 221 to the opening 224, where such an opening forming a channel having conical dimensions. In addition, FIG. 2 illustrates the barrier 230 as having the same size as the opening 224. While this configuration provides a mounting location for the barrier 230, in another embodiment, the barrier 230 can be larger than the opening 224 and can be operatively connected to a surface of the back wall 210 or another structure of the back wall 210 or the top wall 206.

The selective barrier 230 can include an oleophobic membrane placed between the vent 221 and the chamber 214. The membrane includes holes or pores having a size such that the meniscus strength of the liquid ink overcomes any pressure to push ink past the holes into the vent 221 or into the associated air channel. Such pressures can include pressures resulting from tilting of the printheads, ink splashing within the reservoir, or an applied vacuum. The selective barrier includes a low surface energy such that when the pressure is removed, the ink can slide from the membrane back into the chamber 214.

Figure 3:
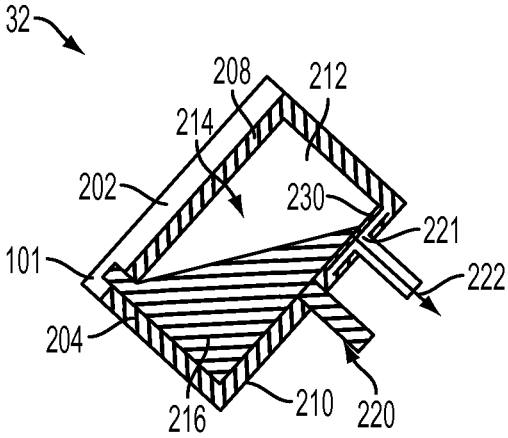
FIG. 3 is a simplified side cross-sectional view of one embodiment of a printhead in a non-operating or tilted position.

FIG. 3 illustrates one position where tilting of the printhead assembly 32 can move ink along the back wall 210 to the location of the selective barrier 230. In this position, however, liquid ink does not enter into the vent 221 or into the supply channel 150 due to the location and characteristics of the selective barrier 230. In FIG. 3, when the printhead assembly 32 is tilted as illustrated, the ink creates a positive pressure on the selective barrier 230. Without this barrier 230, the ink can flow into the conduit 150. In this embodiment where the conduit is not always heated, the ink can solidify, blocking the air path to the pressure source 130 and to atmosphere. In this condition, if ink is loaded into the chamber 214 or deposited from the printhead assembly 32, a large number of nozzles can fail to eject ink due to the positive or negative pressures generated as the ink volume in the reservoir changes. Even in printers having heated ink conduits, the selective barrier 230 can reduce or eliminate a blocking of the air path. For instance, in some printers heat applied to the ink conduits can be turned off when not loading ink into a reservoir to thereby reduce power consumption. During these periods, the vent can become blocked if no filter is present. Likewise, if ink travels through a conduit back to the pressure source when there is no filter, the pressure source can become obstructed and the air path to the reservoir can be blocked.

To substantially prevent the vent 221 from being blocked by ink while still enabling the pressurization of the reservoir 102 through the vent 221, the surface tension and/or contact angle control of the filter 230 can be selected to resist ink from collecting on the filter. The filter 230 can include a material having a sufficient oleophobicity and by selecting the size of the holes in the material. While the material can be selected to provide the desired amount of oleophobicity as an inherent property of the material, in other embodiments the selected material can be coated with an oleophobic coating such that the underlying material supporting the coating need not include the desired oleophobicity.

Figure 4:
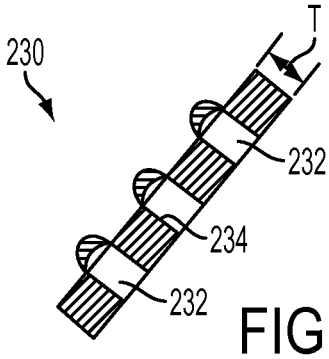
FIG. 4 is a simplified schematic side cross-sectional view of a selective barrier including a plurality of holes in a non-operating or tilted position.
Figure 5:
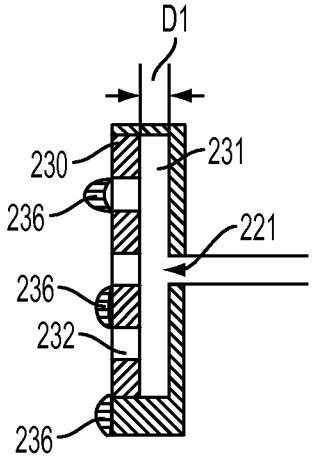
FIG. 5 is a simplified schematic side cross-sectional view of a selective barrier including a plurality of holes in operating position.

FIG. 4 is a simplified schematic side cross-sectional view of the selective barrier 230 including a plurality of the holes 232 in a non-operating or tilted position such as that illustrated in FIG. 3. In the FIG. 4 depiction, the holes 232 have been enlarged to illustrate dimensions and do not depict the actual size or actual number of holes in a selective barrier 230. As can be seen in FIG. 4, the barrier 230 includes a thickness "T" such that each of the holes 232 defines a channel having an interior surface 234. If the filter 230 is coated with an oleophobic coating, the coating can be deposited over all surfaces of the filter 230 including the interior surfaces 234 of the channels defining the holes 232. If the printhead is positioned as in FIG. 3, a pressure is applied to the filter 234 and ink drops 236 can form a meniscus thereby keeping the ink away from the interior surfaces 234 of the channels due to the surface tension forces of the ink. When the printhead is reoriented to the operating position as illustrated in FIG. 5, ink 236 is repelled by the surface and slides off the surface of the filter 230 when the pressure is relieved. The ink drops 236 can flow similarly to the sequence shown in order from top to bottom of the filter 230, with the bottom drop being a final state before sliding back into the ink reservoir. The same movement of ink on the surface of the filter 230 can occur with pressures resulting from ink splashing within the printhead 32 or from an applied vacuum. By providing a filter having the described oleophobic properties, corrective action and field failures resulting from solidified ink are substantially reduced or prevented.

As previously described, phase change ink printheads can be heated to maintain the phase change ink in a liquid state while in a printing mode. When the printer is not being used, however, the printer can enter an energy saving mode where the heat applied to maintain the phase change ink in a liquid state for printing can be reduced. For instance, the printer can enter the energy saving mode during the day if the printer is not being used for a predetermined period of time or can enter the energy saving mode overnight due to a longer period of inactivity. When printing resumes, the temperature is raised to return the temperature of the ink to the printing temperature.

The printhead 32 and reservoirs 102, 104, 106, and 108 are generally sufficiently heated to maintain the ink in a liquid state. In some case, such as periods of reduced heating in the energy saving mode, ink can contact the filter and solidify on the surface of the filter 230. While the filter 230 has prevented ink from entering the vent 221, the solidified ink on the filter 230 can impede the application of pressure through the vent 231 delivered by the pressure source 130. Once the printhead and reservoirs are returned to the operating temperature for printing, however, the temperature within the cavity can be sufficient to melt solidified ink on the filter 230. Upon returning the printhead and reservoirs to the printing temperature, the ink on the filter 230, now liquefied, falls back into the reservoir and operating pressures from the pressure source 130 can be maintained. In the unlikely event that ink does not sufficiently drain from the vent filter, the next purge operation can apply sufficient pressure to clear the vent filter holes of residual ink.

FIG. 5 also illustrates the space 231 which provides for a transitional volume between the vent 221 and the filter 230. While the filter 230 is shown as being sized to fit within the larger opening 224, the filter 230 can be located outside the opening 224 such that the filter 230 need not have a size the same as the opening 224. By providing a transitional volume between the vent 221 and the filter 230, a change in pressure at the interface between the filter 230 and the vent 220 can be substantially reduced to avoid back pressure from affecting the flow of ink in the conduit operatively connected to the reservoir.

Figure 6:
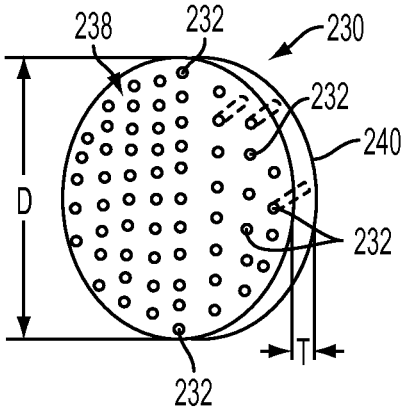
FIG. 6 is a simplified schematic perspective view of a selective barrier including plurality of holes.

FIG. 6 is a simplified schematic perspective view of one embodiment of a selective barrier 230 including plurality of holes 232 extending from a first side 238 to a second side 240. While the barrier 230 is illustrated as being circular, other configurations are possible. In one embodiment, the barrier 230 includes a disc made of a polytetrafluoroethylene material having an array of 10 μm holes. The holes can be arranged in a predetermined pattern or randomly throughout the barrier 230. The holes can be laser drilled into the material. In another embodiment, the barrier 230 can be formed to include holes formed during part of molding process. Alternatively, holes can be molded into the filter, punched through the filter, or can be made of a pressed mesh of oleophobic fibers. By determining the properties of the phase change ink, the filter can be optimized by adjusting the size of the holes, the type of material, the surface properties of the material, and the properties of the oleophobic coating if used. In another embodiment, the barrier can include a polyimide material having a plurality of laser drilled holes which can range from 10 μm to 40 μm in diameter and spaced apart by a distance of approximately 10 μm to 20 μm. In one embodiment, the total area all holes within a filter can be approximately 2 $mm^2$ to 20 $mm^2$. Once the material has been drilled, the material can be coated with an oleophobic coating such as fluorodecyltrichlorosilane or an amorphous fluoropolymer such as Teflon® AF1600 available from DuPont Fluoropolymers of Wilmington, Del.

It will be appreciated that variants of the above-disclosed and other features and functions, or alternatives thereof, can be desirably combined into many other different systems, applications or methods. For instance the described embodiments and teachings can be applied to phase change ink printing systems printing directly to a continuous web or to sheets of recording media. In addition, printhead assemblies can include assemblies having one or more printheads and associated ink reservoirs contained within a single housing. Other printhead assemblies can include a printhead having a length sufficient to print a single swath of ink across the recording media in one pass. Still other printhead assemblies can include ink reservoirs which are not located in the same housing as the printhead but which are located elsewhere. Consequently, various presently unforeseen or unanticipated alternatives, modifications, variations or improvements can be subsequently made by those skilled in the art that are also intended to be encompassed by the following claims.

What is claimed is:

1. A phase change ink storage reservoir for supplying heated phase change to a printhead comprising:

a housing having a chamber configured to hold a supply of melted phase change ink, the housing including a phase change ink inlet configured to deliver melted phase change ink to the chamber, a phase change ink outlet operatively connected to the printhead and configured to deliver the melted phase change ink from the chamber to the printhead, and a vent configured to expose the chamber to a gas pressure; and a selective barrier spaced a predetermined distance from the vent, the selective barrier including a plurality of holes, each hole having a size configured to substantially prevent a pressure within the chamber that moves the melted phase change ink into the vent.

2. The phase change ink storage reservoir of claim 1, the selective barrier further comprising:

an oleophobic material.

3. The phase change ink storage reservoir of claim 1, the selective barrier further comprising:

an oleophobic coating to repel the melted phase change ink.

4. The phase change ink storage reservoir of claim 3 wherein each hole in the plurality of holes defines an interior surface and the oleophobic coating is deposited on the interior surface of each hole.

5. The phase change ink storage reservoir of claim 4, the selective barrier further comprising:

a polyimide material.

6. The phase change ink storage reservoir of claim 5, the plurality of holes are a plurality of laser drilled holes in the polyimide material.

7. The phase change ink storage reservoir of claim 6, the oleophobic coating being essentially comprised of a fluorodecyltrichlorosilane material.

8. The phase change ink storage reservoir of claim 6, the oleophobic coating being essentially comprised of an amorphous fluoropolymer material.

9. The phase change ink storage reservoir of claim 1 further comprising:

a heater operatively connected to the housing, the heater being configured to heat the housing to a predetermined temperature to melt the phase change ink within the chamber.

10. The phase change ink storage reservoir of claim 9, the housing further comprising:

an opening disposed adjacent to the vent, the opening having a cross section larger than a cross section of the vent.

11. The phase change ink storage reservoir of claim 10, wherein the selective barrier is disposed within the opening of the housing.

12. The phase change ink storage reservoir of claim 10 wherein the selective barrier is disposed adjacent to the opening of the housing.

13. The phase change ink storage reservoir of claim 10, the selective barrier further comprising:

an oleophobic material.

14. The phase change ink storage reservoir of claim 13, wherein the plurality of holes are a plurality of laser drilled holes in the oleophobic material.

15. A printhead assembly for use in an imaging device to deposit melted phase change ink on an image receiving member comprising:

a housing having a chamber configured to hold a supply of the melted phase change ink, the housing including a phase change ink inlet configured to deliver melted phase change ink to the chamber, a phase change ink outlet configured to deliver melted phase change ink from the chamber, and a vent configured to expose the chamber to a gas pressure;

a selective barrier spaced a predetermined distance from the vent, the selective barrier including a plurality of holes, each hole having a size configured to substantially prevent a pressure within the chamber that moves the melted phase change ink into the vent; and a plurality of ink drop actuators, each actuator being operatively connected to the phase change ink outlet to emit drops of melted phase change ink on the image receiving member.

16. The printhead assembly of claim 15 wherein the selective barrier is spaced from the vent by an open space.

17. The printhead assembly of claim 16 wherein the selective barrier includes a cross section larger than a cross section of the vent.

18. The printhead assembly of claim 17, the selective barrier further comprising:

an oleophobic material.

19. The printhead assembly of claim 18 wherein the plurality of holes are a plurality of laser drilled holes in the oleophobic material.

20. The printhead assembly of claim 15 further comprising:

a pressure source operatively connected to the vent, the pressure source being configured to direct a pressure through the vent.

* * * * *